US011015624B2

(12) United States Patent
Marquardt

(10) Patent No.: US 11,015,624 B2
(45) Date of Patent: May 25, 2021

(54) METHODS AND DEVICES FOR CONSERVING ENERGY IN FLUID POWER PRODUCTION

(71) Applicant: Steven H. Marquardt, Rhinelander, WI (US)

(72) Inventor: Steven H. Marquardt, Rhinelander, WI (US)

(73) Assignee: Steven H. Marquardt, Rhinelander, WI (US)

( * ) Notice: Subject to any disclaimer, the term of this patent is extended or adjusted under 35 U.S.C. 154(b) by 0 days.

(21) Appl. No.: 16/742,355

(22) Filed: Jan. 14, 2020

(65) Prior Publication Data

US 2020/0149563 A1 May 14, 2020

Related U.S. Application Data

(63) Continuation-in-part of application No. 16/350,185, filed on Oct. 9, 2018, and a continuation-in-part of application No. 15/731,294, filed on May 19, 2017, now Pat. No. 10,550,863, which is a continuation-in-part of application No. 15/731,294, filed on May 19, 2017, now Pat. No. 10,550,863.

(60) Provisional application No. 62/606,864, filed on Oct. 10, 2017, provisional application No. 62/392,028, filed on May 19, 2016.

(51) Int. Cl.
*F15B 21/14* (2006.01)

(52) U.S. Cl.
CPC ..... *F15B 21/14* (2013.01)

(58) Field of Classification Search
CPC ..... F15B 1/021; F15B 1/024; F15B 11/024; F15B 2011/0243; F15B 13/021; F15B 2211/212; F15B 2211/265; F15B 2211/3057; F15B 2211/31582
USPC ..... 91/436, 437, 438
See application file for complete search history.

(56) References Cited

U.S. PATENT DOCUMENTS 2,001,620 A 8/1934 Levy
2,147,536 A 11/1937 Levy
(Continued)

FOREIGN PATENT DOCUMENTS

DE 102009008367 A1 * 8/2010 ..... F15B 11/024
DE 102012101120 A1 * 8/2013 ..... F15B 1/024

*Primary Examiner* — Abiy Teka
*Assistant Examiner* — Matthew Wiblin
(74) *Attorney, Agent, or Firm* — Andrus Intellectual Property Law, LLP

(57) ABSTRACT

A valve for controlling a flow of a fluid between a source, reservoir, a vent, and pressure-based device. The valve has multiple positions each having a source port fluidly coupleable to the source, reservoir port fluidly coupleable to the reservoir, device port fluidly coupleable to the pressure-based device, and venting port configured to vent the fluid. The multiple positions are separately selectable and include a fill position having a fill conduit fluidly coupling the source port and device port, a recycle position having a recycle conduit fluidly coupling the reservoir port and device port, and a vent position having a vent conduit fluidly coupling the vent port and device port. The fill conduit, recycle conduit, and vent conduit each communicate the fluid only when a corresponding one of the multiple positions is selected, and the multiple positions are configured to prevent selection of more than one at a time.

20 Claims, 12 Drawing Sheets

(56) References Cited

U.S. PATENT DOCUMENTS 2,356,366 A * 8/1944 Wise ..... F15B 11/022 91/29
2,385,351 A 9/1945 Davidsen
2,813,970 A 11/1957 Martinson
2,856,222 A 10/1958 Gossett
2,977,763 A * 4/1961 Mercier ..... F15B 11/022 60/416
3,104,125 A 9/1963 Garlinghouse
3,436,913 A 4/1969 Muller
3,476,016 A 11/1969 Dixon
3,570,244 A 3/1971 Strobel
3,608,431 A 9/1971 Pease
3,791,690 A 2/1974 Garlinghouse
3,956,891 A 5/1976 Karazija
4,161,135 A 7/1979 Garlinghouse
4,211,078 A 8/1980 Bass
4,226,167 A 10/1980 Lew
4,397,221 A 8/1983 Friesen
4,633,665 A 1/1987 Buter
4,635,532 A 1/1987 Tanino
4,840,111 A 6/1989 Garnjost
4,969,562 A 11/1990 Yoshimi
5,007,544 A 4/1991 Saotome
5,050,380 A 9/1991 Johnsson
5,065,664 A 11/1991 Ohta
5,074,192 A 12/1991 Gheorghita
5,214,997 A 6/1993 Lebret
5,237,916 A * 8/1993 Malashenko ..... B30B 15/161 100/269.14
5,310,315 A 5/1994 Lafortune
5,370,038 A 12/1994 Poppe
5,415,076 A 5/1995 Krone
5,417,064 A 5/1995 Galuszka
5,452,643 A 9/1995 Smith
5,568,759 A 10/1996 Aardema
5,570,286 A 10/1996 Margolis
5,609,088 A 3/1997 Park
5,611,259 A 3/1997 Nagata
5,749,390 A 5/1998 Ermacora
5,960,695 A 10/1999 Aardema
6,095,028 A 8/2000 Lamas
6,170,383 B1 1/2001 Mauritz
6,267,548 B1 7/2001 Lech
6,327,956 B1 12/2001 Rink
6,354,790 B1 3/2002 Cummings
6,398,181 B1 * 6/2002 Dettmers ..... E21D 23/16 251/25
6,418,715 B1 7/2002 Huber
6,467,264 B1 10/2002 Stephenson
6,516,766 B2 2/2003 Porter
6,658,842 B2 12/2003 Yamasaki
6,691,604 B1 2/2004 Hajek
6,871,574 B2 3/2005 Barber
7,104,181 B2 9/2006 Bitter
7,219,592 B2 5/2007 Nielsen
7,487,707 B2 2/2009 Pfaff
8,028,613 B2 10/2011 Wrede
8,225,706 B2 7/2012 Vigholm
8,453,762 B2 6/2013 Law
8,549,983 B2 10/2013 Brahmer
8,635,940 B2 1/2014 Goldfarb
8,869,924 B2 10/2014 Kim
9,523,184 B2 12/2016 Kim
9,599,248 B2 3/2017 Goldfarb
9,605,768 B2 3/2017 Goldfarb
9,702,118 B2 7/2017 Gorman
2006/0201321 A1 9/2006 Loedige
2006/0249016 A1 11/2006 Ioka
2008/0216471 A1 * 9/2008 Staudinger ..... F16H 61/0021 60/418
2010/0071788 A1 * 3/2010 Stehr ..... F15B 11/042 137/625.65
2011/0005625 A1 1/2011 Goldfarb
2012/0048396 A1 * 3/2012 Takemoto ..... F16K 5/0647 137/487.5
2014/0158922 A1 6/2014 Goldfarb
2015/0330527 A1 11/2015 Goldfarb
2015/0354172 A1 12/2015 Hijikata
2015/0354720 A1 12/2015 Goldfarb
2016/0201813 A1 7/2016 Goldfarb
2019/0032686 A1 1/2019 Mell et al.
2019/0040878 A1 2/2019 Mell et al.

* cited by examiner

METHODS AND DEVICES FOR CONSERVING ENERGY IN FLUID POWER PRODUCTION

CROSS-REFERENCE TO RELATED APPLICATIONS

This application is a Continuation-in-Part of U.S. patent application Ser. No. 15/731,294, filed May 19, 2017, which claims the benefit of U.S. Provisional Patent Application No. 62/392,028, filed May 19, 2016, and also of U.S. patent application Ser. No. 16/350,185, filed Oct. 9, 2018, which claims the benefit of U.S. patent application Ser. No. 15/731,294 (filed May 19, 2017) and also U.S. Provisional Patent Application No. 62/606,864 (filed Oct. 10, 2017).

FIELD

The present disclosure generally relates to devices and methods for producing fluid power (pneumatic and hydraulic), and more particularly to devices and methods that increase efficiency in the movement of the air and fluid during their working cycles.

Currently, various hardware is employed in an attempt to increase efficiency with little benefit for added cost and complexity of manufacture verses the actual efficiency gain.

BACKGROUND

In the field of fluid power (pneumatic and hydraulic) experts have always looked for opportunities to increase efficiency in the movement of the air and fluid during their working cycles. Currently, various hardware is employed in an attempt to increase efficiency with little benefit for added cost and complexity of manufacture verses the actual efficiency gain.

To understand the new technology proposed in this application, a brief summary of a conventional fluid power circuit follows, as shown in FIG. 1.

In a conventional pneumatic circuit, the incoming pressure 24 is sent to an actuator (a cylinder 32) through a controlling main valve 20 that will pressurize a first side 30 of the cylinder 32 while exhausting the air from a second side 40 of the cylinder 32. This is accomplished through control of the main valve 20. In some embodiments, the main valve 20 is controlled through pilot operated valves 48*a*, 48*b* (as shown in FIGS. 2, 3, 4, and 5) in a conventional manner known in the art.

It should be noted that while reference is made to a cylinder 32 is the actuator for simplicity, the presently disclosed systems and methods are not limited to just cylinders.

Pressurizing the first side 30 and exhausting the second side 40 makes the cylinder 32 move by displacement of the piston assembly 26 and rod 28 positioned therein. This movement can then be harnessed to produce the desired work.

To return the cylinder 32 to its original starting position for another cycle, the main valve 20 changes to send incoming pressure 24 to the second side 40 while allowing the first side 30 to "vent" exhaust through the main valve 20 via vents 22, 22'. Instead of exhausting through the main valve 20 body, exhaust air may also be vented directly at the cylinder 32 through "quick exhaust" shuttle valves (not shown).

In Hydraulic power configurations known in the art generally operate in the same manner previously described.

However, in a hydraulic circuit, the fluid is not vented to atmosphere, but is returned to an unpressurized reservoir (not shown) by fluid lines to be pressurized again. In the present disclosure, reference is generically be made to the fluid (whether air or liquid) being exhausted out into a reservoir even where it is exhausted into the atmosphere.

SUMMARY

The present disclosure generally relates to an improved method and circuitry for fluid power applications that provides energy savings through the recycling of normally exhausted pressure by direct transfer and accumulation of exhaust pressure for additional use, including from one end of the actuator to the opposite end or within the actuator itself and for use by other devices in separate systems.

One embodiment according to the present disclosure generally relates to a valve for controlling a flow of a fluid between a source, a reservoir, and a pressure-based device. The valve includes a plurality of positions each having a source port configured to be fluidly coupled to the source, an reservoir port configured to be fluidly coupled to the reservoir, a device port configured to be fluidly coupled to the pressure-based device, and a venting port configured to vent the fluid to atmosphere. The plurality of positions are separately selectable and include a fill position having a fill conduit that fluidly couples the source port and the device port, a recycle position having a recycle conduit that fluidly couples the reservoir port and the device port, and a vent position having a vent conduit that fluidly couples the vent port and the device port. The fill conduit, the recycle conduit, and the vent conduit each communicate the fluid only when a corresponding one of the plurality of positions is selected, and the plurality of positions are configured to prevent selection of more than one at a time.

Another embodiment according to the present disclosure generally relates to a system for conserving energy in operating a pressure-based device by controlling a flow of a fluid between a source, a reservoir, a vent, and the pressure-based device. The system includes a valve for controlling the flow of the fluid between the source, the reservoir, and the pressure-based device. The valve has a plurality of positions each having a source port configured to be fluidly coupled to the source, an reservoir port configured to be fluidly coupled to the reservoir, a device port configured to be fluidly coupled to the pressure-based device, and a venting port configured to vent the fluid to atmosphere. The plurality of positions are separately selectable and include a fill position having a fill conduit that fluidly couples the source port and the device port, a recycle position having a recycle conduit that fluidly couples the reservoir port and the device port, a vent position having a vent conduit that fluidly couples the vent port and the device port, and a selection device for selecting among the plurality of positions. The fill conduit, the recycle conduit, and the vent conduit each communicate the fluid only when a corresponding one of the plurality of positions is selected, and where the plurality of positions are configured to prevent selection of more than one at a time.

Another embodiment according to the present disclosure generally relates to a method for conserving energy while using a pressure-based device operated by controlling a flow of a fluid between a source, a reservoir, a vent, and the pressure-based device. The method includes fluidly coupling a valve between the source, the reservoir, the vent, and the pressure-based device. The method further includes configuring the valve to have a plurality of positions each having a source port configured to be fluidly coupled to the source, an reservoir port configured to be fluidly coupled to the reservoir, a device port configured to be fluidly coupled to the pressure-based device, and a venting port configured to vent the fluid to atmosphere. The method further includes configuring the valve such that the plurality of positions are separately selectable. The method further includes configuring the valve to perform each of: positioning the valve in a fill position among the plurality of positions in which the source port and the device port are fluidly coupled; positioning the valve in a recycle position among the plurality of positions in which the reservoir port and the device port are fluidly coupled; and positioning the valve in a vent position among the plurality of positions in which the vent port and the device port are fluidly coupled. The method further includes configuring the valve to prevent selecting more than one of the plurality of positions at a time. Energy is conserved when the fluid flows through the valve in the recycle position.

DRAWING DESCRIPTIONS

SPECIFICATION

This written description uses examples to disclose embodiments of the present application, including the best mode, and also to enable any person skilled in the art to practice or make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The present applicant has recognized that with conventional systems and methods known in the art, significant operating time is also lost waiting for the air or fluid to fill and empty from both sides of a conventional circuit. In either case, the pressurized air or fluid is "dumped" to exhaust, without doing further work, every time the stroke changes direction. There is significant cost for the pressurization and forcing of the fluid medium through the circuit. Therefore, this conventional practice of dumping at every stroke results in expensive energy needing to be expended every time the cylinder cycles.

To allow a smaller pump size, some systems in the art have incorporated regenerative circuits are sometimes used to increase the speed of the extend cycle of a cylinder. Specifically, these systems allow exhaust from the rod end to "re-combine" with incoming pressure at the cap end. These regenerative circuits are strictly limited to extending the cylinder and the resulting pressure is significantly reduced in force.

In addition, the present applicant has identified that a regenerative cylinder must also be specially sized to allow all of the exhaust from the rod end to be accepted on the opposite side, and that additional, special valves and controls must be used. This is why regenerative circuits are not widely utilized for most applications, due to significant design time, special cylinders and valves that add significantly to initial cost.

No other prior art teaches, suggests, or implies any alternate systems or methods to recover a significant amount (often 50 percent or more) of the unused energy available in the pressure differential that exists between opposing operations within an actuator prior to the exhaust function.

Operational Definitions

In conventional fluid dynamics there are several fundamental functions and descriptions. For clarity they will defined in this section.

In a cylinder, it is possible for one side to not have a rod included. This is sometimes called the "cap" end. As a consequence for not having a rod, the working volume of the cap end is greater and, consequently, that side of the piston has a larger surface area for the pressure to push against. This creates greater applied force on the cap side of the cylinder.

Figure 1:
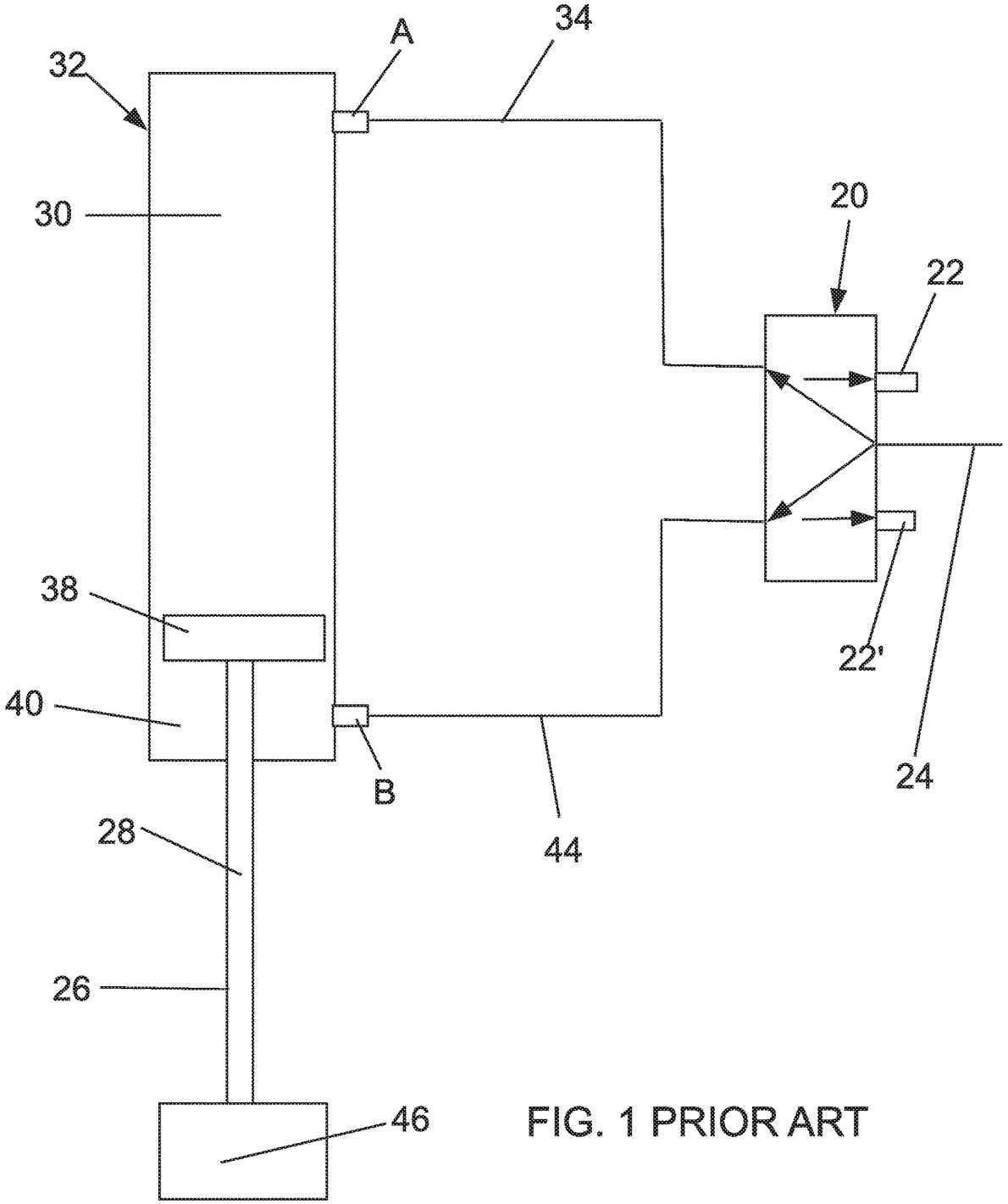
FIG. 1 PRIOR ART
FIG. 1 is a plan view of a conventional pneumatic circuit.

For clarity in this application, the cap side will also be called the "Extend" side of the cylinder 32 (side 30 in FIG. 1) as pressure applied here will cause the cylinder 32 to extend. The opposing side (i.e., the side that includes the rod 28) will also be called the "Retract" side (side 40 in FIG. 1) as the cylinder 32 retracts when pressure is applied here. Because of the reduction in surface area where the rod 28 is attached to the piston 38, this side has less applied force than the Extend 30 side at the same pressure.

It is also beneficial to define both a "Primary" side and a "Secondary" side of the circuit. The Primary side is the side of the cylinder that is receiving the incoming pressure 24 from the main valve 20 to move the piston assembly 26. In contrast, the Secondary side is the side that is exhausting pressure to allow movement of the piston assembly 26. Therefore, the Primary and Secondary sides may be located at either side Extend 30 or Retract 40 of the cylinder 32, depending on cylinder cycle position when main valve 20 is shifted.

The systems and methods of the present disclosure recycle a significant portion (over 50 percent) of this previously wasted energy during every work cycle as discussed further below. These systems and methods work in vacuum or positive pressure applications, in single or double acting cylinders and in other mechanisms such as diaphragm pumps or intensifiers. All that is required is a pressure differential to exist prior to the normal exhaust function.

The Direct Link Circuit

A pressure differential always exists between the two sides of a cylinder (a typical actuator) at the end of each stroke, in both directions of travel. Therefore, the present applicant has identified that there is an opportunity to recycle the existing pressure prior to it being exhausted or returned to a reservoir.

The systems and methods presently disclosed, sometimes referred to as the Direct Link Circuit (DLC), provide for the recycling of the existing pressure differential at the end of each stroke in both directions of travel. The DLC provides this recycling by establishing a new, controllable circuit between the two opposing ends of a cylinder at the ends of each stroke.

In one embodiment, the DLC provides a way to recycle existing pressure by creating a new pathway for pressure to follow directly from the high pressure side to the low pressure side to save valuable energy that would be exhausted in a "conventional circuit" and need to be created again.

Figure 2:
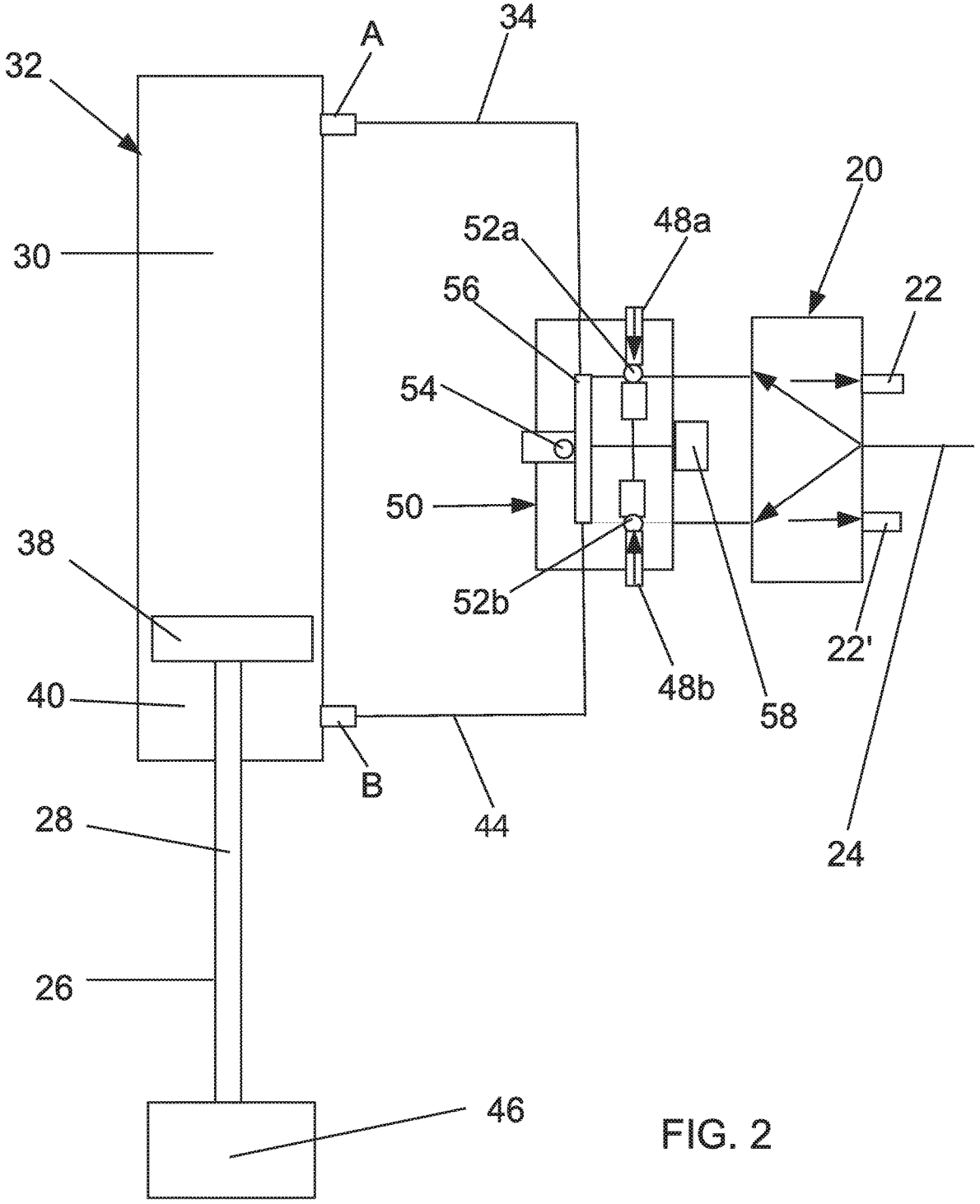
FIG. 2 is a plan view of a conventional circuit with the new Energy Saving Valve (ESV) installed.

As seen in FIG. 2, a new valve, called the Energy Saving Valve 50 (ESV), is inserted between the two "conventional" circuit lines 34, 44 required for system operation. The ESV 50 is located between the main valve 20 and cylinder 32 and creates a controllable, new Direct Link passage 56 between the opposing ends A, B of the cylinder 32. The ESV 50 provides a means to stop the flow to and from the main valve 20, while at the same time creating a new Direct Link passage 56 that directly connects the first and second sides A, B of the cylinder 32. Specifically, this is accomplished by closing the two blocking valves 52*a*, 52*b*, while at the same time opening the Link valve 54 that connects the two cylinder sides A, B, (which are connected to lines 34, 44) with the new Direct Link passage 56.

Figure 3:
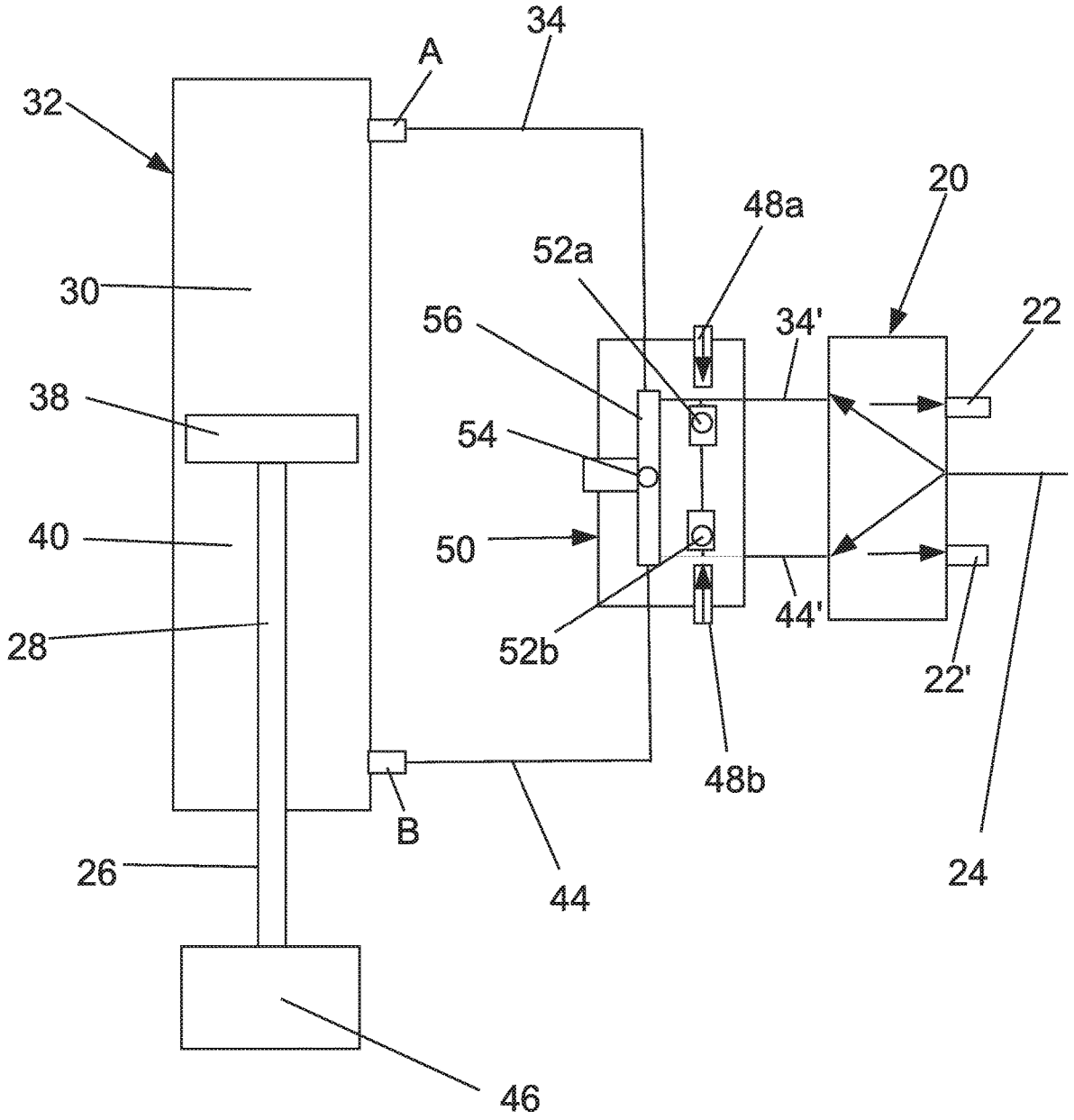
FIG. 3 is a further plan view with the ESV not activated.

In FIG. 2, the ESV 50 is shown in the "activated" position, which allows the existing pressure from side 30 to flow directly to the un-pressurized side 40 through the Direct Link passage 56, while also closing Lines 34 and 44 to the main valve 50. For example, if side 30 has a pressure of 100 PSI (pounds per square inch) and side 40 has a pressure of 0 PSI (a normal circuit situation at end of stroke), the pressurized air will flow directly to the low pressure of the cylinder (side 40) while simultaneously lowering the pressure on the originating high pressure side (side 30). When pressure balance is achieved, the pressure differential will no longer exist and the piston/load will stop moving (as shown in FIG. 3). In other words, both sides 30, 40 are now equal in force when adjusted for rod 28 differential.

At this point, the Direct Link passage 56 closes using Link valve 54 and pressure is exhausted from the Primary side, presently side 30 using pilot 48*a* and blocking valve 52*a* through the main valve 20. This sequential operation function creates a new pressure differential where the Secondary side, side 40, now has greater pressure than Primary side, side 30, which continues to move the piston assembly 26 and load 46.

During this exhausting of side 30, valve 52*b* remains closed, providing time for the piston assembly 26 and load 46 to move. This allows the stored pressure on the Secondary side, side 40, to finish the stroke with no opposing pressure on Primary side, side 30.

In certain embodiments, pilot operated valves 48*a* 48*b* or other control devices can be utilized to force the blocking valves 52*a*, 52*b* open or closed as needed for this exhausting function.

When desired, the ESV 50 will fully re-open the normal circuit using valve 52*b* to resume normal operation through main valve 20. This action allows the incoming pressure 24 to top off the cylinder 32 (on either side 30 or 40) with full pressure as needed. It should be noted that in conventional circuits, the overall circuit is usually over-designed for force, which allows even a smaller pressure force to move the actuator a significant distance.

This allows the DLC to return a cylinder 32 in both directions using existing pressure differential that would normally be exhausted saves significant energy over conventional operation.

Re-opening of the normal circuit can be accomplished by conventional control devices, such as timers, limit switches, regulators, etc. These can also be electrically operated, such as with a solenoid. It should be noted that each of these control devices are adjustable and can be built directly into the ESV 50.

At initial activation of the ESV 50, a High pressure differential will exist between side 30 and side 40 of the cylinder 32, causing rapid movement of the cylinder piston. For better control, flow controls may be incorporated within the ESV 50 to regulate this flow in a manner known in the art (not shown). This allows the ESV 50 to be adjustable for cycle time or pressure due to factors such as existing load, operational speed desired, etc.

Figure 4:
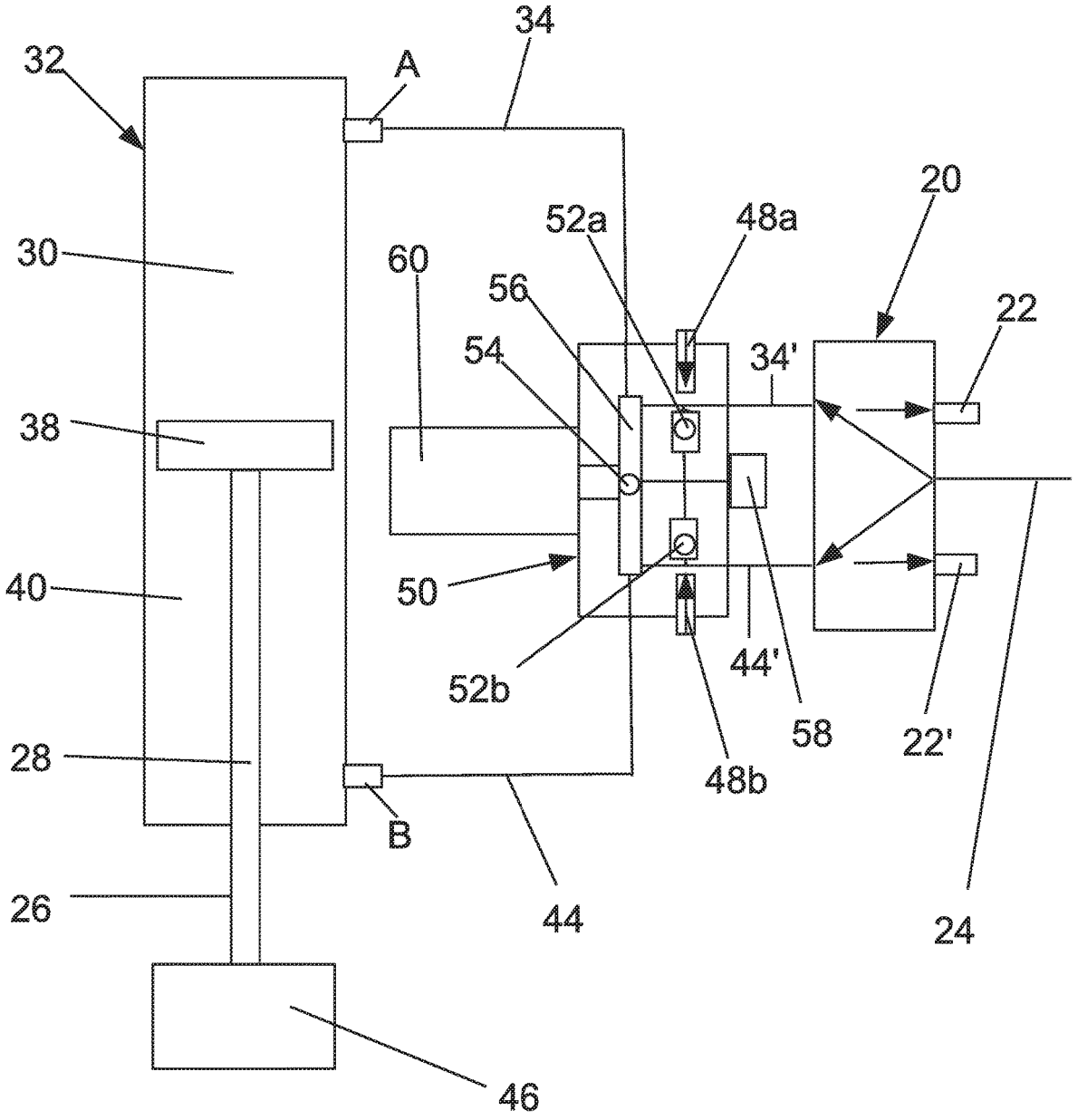
FIG. 4 is a further plan view with the ESV activated.

The ESV 50 can further incorporate conventional control devices into one unit to establish the Direct Link Circuit required for energy savings. As non-limiting examples, these include flow controls, timers, regulators, shuttle valves, etc. FIG. 4 shows one such optional timer 58. Likewise, the ESV 50 may be built directly into the main valve 20 body as one unit, thus eliminating lines 34' and 44'.

In certain embodiments, two vents (which may be pilot, timer, or otherwise operated) are provided in the ESV 50 such that when the Direct Link passage 56 closes, the Primary pressure side will vent the remaining pressure directly at the ESV 50.

Figure 5:
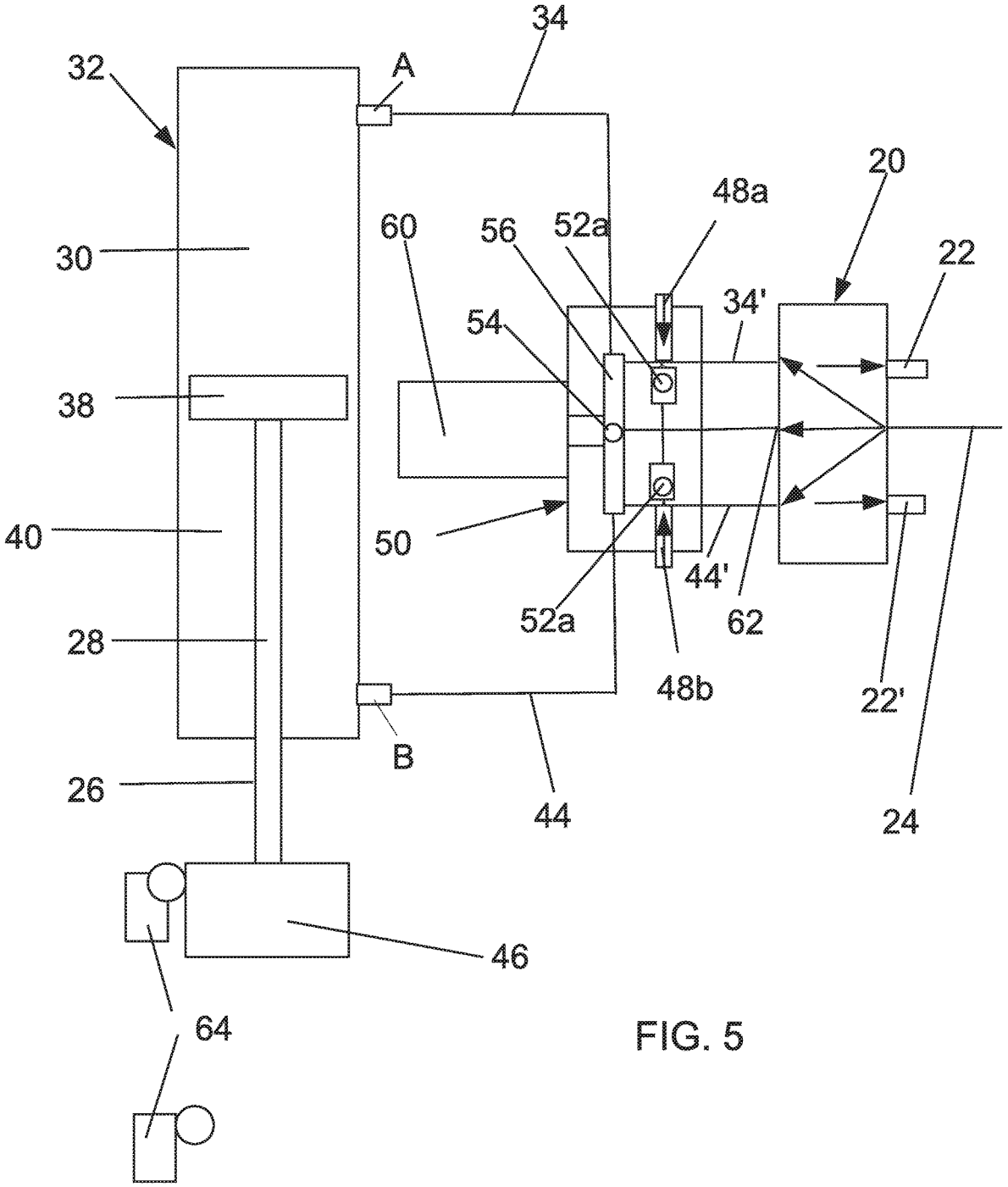
FIG. 5 is a further plan view with the ESV activated and an accumulator and limit switches added.

In other embodiments, such as those shown in FIGS. 4 and 5, the ESV 50 can further incorporate an Accumulator 60 to store additional pressure for use by the Secondary side. This provides a larger increase in the amount of pressure recycled. Specifically, the Accumulator 60 further provides a means to permit more pressure to leave the Primary side without venting it to exhaust, allowing further actuator movement. The Accumulator's 60 pressure can also serve to activate a binary or other type valve for system operation. In certain embodiments, the Accumulator 60 may also be installed at a separate location for space considerations, using conventional tubing or pipe to conduct the flow (not shown).

Another novel way of activating any DLC is to provide a main valve 20 port (shown at the center position 62) that is activated as the valve shifts, as shown in FIG. 5. Activation of the Direct Link Circuit can be from any control device such as: the limit switches 64, from one of the pressurized lines of the main circuit (34, 44) or a pilot valve based on a set pressure or lack of pressure. As per any fluid power circuit, all valves can be normally opened or closed depending on the activation available or desired. Likewise, all circuitry and controls may also be electronically activated using conventional electronic methods, including position sensors. The DLC may further be directly incorporated into various fluid power devices [such as transfer pumps and intensifiers] to provide additional energy savings (not shown).

Figure 6:
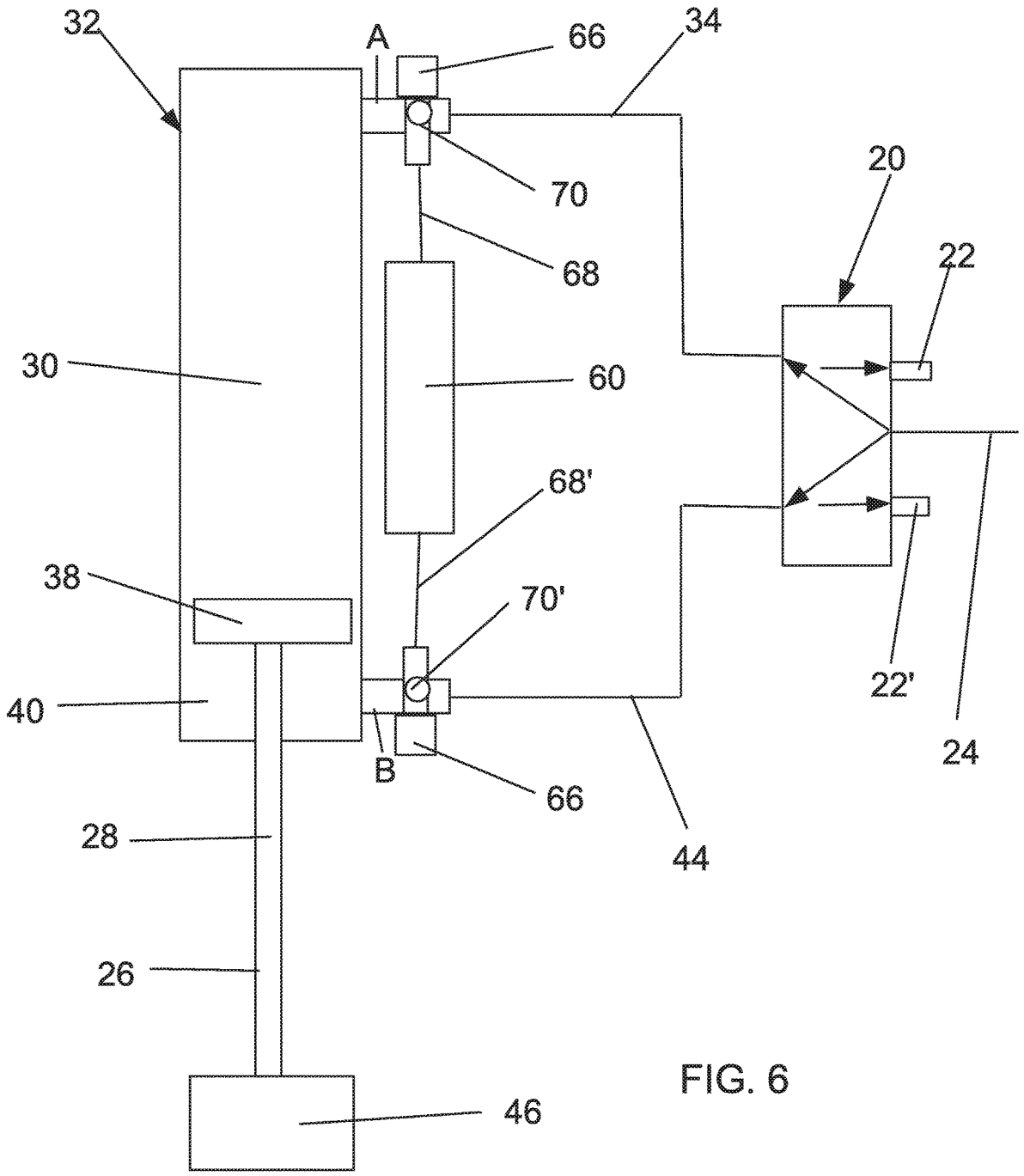
FIG. 6 is a plan view with Component Valves at each cylinder end and an added accumulator.

The new Direct Link Circuit may be provided by a singular ESV 50, as discussed above, or two, individual component valves. As seen in FIG. 6, the DLC incorporates Component Valves 70, 70' (CV's) at each end A, B of the cylinder 32. The CV's 70, 70' provide both the blocking function of the main lines (34, 44) and the connection function to the Direct Link lines 68 and 68'.

The CV's 70, 70' may further include controllable exhaust ports 66, 66' to directly vent exhaust. The CV's 70, 70' can be conventionally activated by normal control devices, or may be internally activated by pressure, vacuum or binary (sequential) means.

A separate Accumulator 60 may be installed directly on the Direct Link line 68, 68' as desired for higher energy savings in accordance with the previous discussion.

This new DLC provides a means to recover a significant portion of the energy of every stroke, in both directions of travel, during operation. The present applicant has identified that this savings is over 50% of the pressurized fluid or air. In this regard, the Direct Link Circuit, using either the ESV 50 or CV's 70, 70', provide a novel means to accomplish more work, while requiring minimal to no additional incoming pressure 24 from the main valve 20.

The Internal Direct Link

Figure 7:
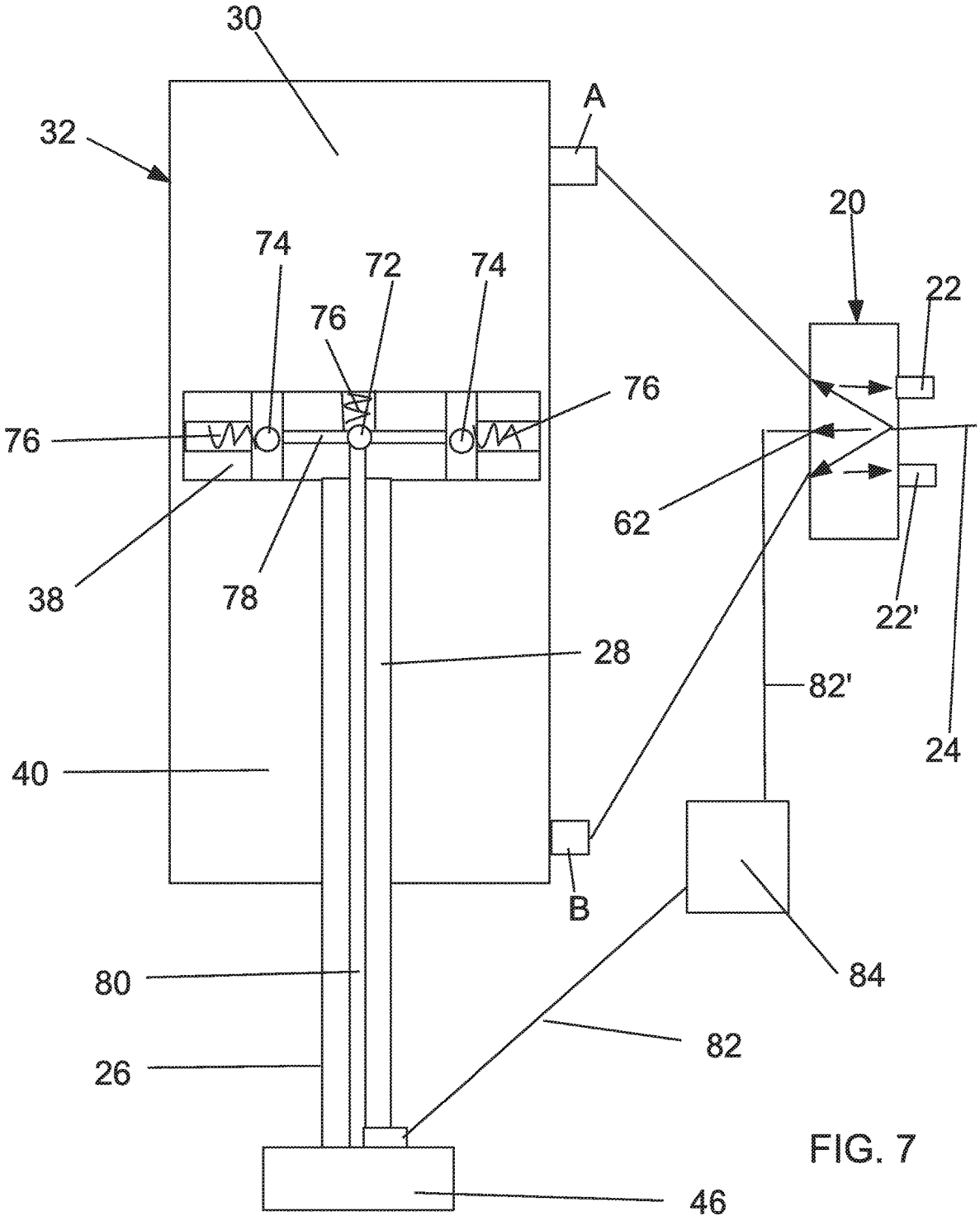
FIG. 7 is a plan view of a cylinder with an Internal Direct Link.

In further embodiments of the present disclosure, the Direct Link Circuit is directly incorporated into the piston 38 of the cylinder 32, as shown in FIG. 7. In these embodiments, the DLC is provided by an internal Piston Link valves 74 and passage 78 located "within" the piston 38 itself. While one valve may be used in some embodiments, it may nonetheless be referred to in the plural form as piston link valves 74. FIG. 7 shows the DLC in the closed position.

The Piston Link valves 74 can be opened by the Activating Line 82, 82' connected directly to the rod 28 of the piston assembly 38. The rod 28 contains an activating passage 80 to allow the activating pressure to reach the internal Activating valve 72. This allows the Activating valve 72 to be used as a trigger for initial opening of the Piston Link valves 74 using passages 78. When the Activating valve 72 opens the secondary passage 78 to the Piston Link valves 74, they will also open, allowing the pressure differential to flow through the piston 38 itself for immediate stroke reversal. The Activating valve 72 (normally closed, spring return) is returned to the closed position by springs 76 once activating pressure is removed. It should be recognized that the springs 76 may also be one spring.

In certain embodiments, a delay timer 84 is used to remove the pressure from the Activating Line 82 to allow activating valve 72 and Piston Link valves 74 to close.

The Piston Link valves 74 (normally closed, spring return) can also be returned to the "closed" position by springs 76 when spring pressure "overrides" the pressure that is passing through piston 38. In this case, the main valve 20 center position 62 would be used to momentarily open the Activating valve 72 and Piston Link valves 74 for operation and no delay Timer 84 would be needed. Activation and timing of the Internal Direct Link can be controlled by conventional or ESV circuitry outside the cylinder 32. Likewise, an external Accumulator 60 may be used to store pressure for later use, as discussed above.

The Internal Direct Link provides a novel way to further speed up cycle time and save energy by building the Direct Link Circuit inside the cylinder 32 itself.

With any embodiments incorporating an accumulator 60, it should be known that the accumulator 60 may be connected to other actuators as desired to provide a "cascade" of usable pressure for additional work. This method allows accumulated pressure to supply other actuators in a system or be re-cycled to the inlet of the pressure generating device (such as a compressor or fluid pump) for further efficiency. In this manner, the initial energy of the first system can be utilized in many different devices and for more energy savings than any conventional system.

The present applicant has identified that the presently disclosed DLC may be provided in various modes to allow adaptation to existing systems, or for completely new installations.

In summary, the Direct Link Circuit establishes a controllable, direct link between the two sides of any actuator. Through this direct link, the existing pressure differential at the end of each stroke can be recycled into additional motion instead of being wasted. Fluid power systems presently known in the art, both pneumatic and hydraulic, currently waste this pressurized air (or fluid) to exhaust (or reservoir tank) because they lack the capabilities now provided by the DLC.

Furthermore, the presently disclosed Direct Link Circuit also provides a way to increase operational speeds and to shorten the distance traveled for the air/fluid flow, thereby increasing cycle speed.

The DLC can be implemented for a low cost and is easily installed as a new device or for retrofitting existing systems.

As described above, the Direct Link Circuits can be further equipped with accumulators 60 for additional energy savings, saving a greater amount of the pressurized fluid or air for reuse. The Internal Direct Link further provides the fastest operation of any cylinder by locating the Direct Link Circuit inside the cylinder itself. The present applicant has demonstrated that the new Direct Link Circuit directly saves energy by recycling a significant portion of the wasted energy of current system operation. By providing a controllable, Direct Link Circuit between the opposing sides of any pressure differential, un-tapped and previously wasted energy is recycled to accomplish additional work.

It should further be understood that persons skilled in the art may reconfigure, add to or "manufacture into" conventional devices the various functions required to establish the novel Direct Link Circuit proposed.

The present inventor has identified that the sequential operations and circuit functions for some of the DLC methods described above can currently only be performed by numerous conventional valves "pieced together" at significant cost and complexity. Therefore, to obtain the optimum results, and with the lowest manufacturing and operating costs, the present inventor has identified a need for novel valves that do not currently exist. The numerous conventional valves would also require significant additional space and often need adjustable controls and additional functions added, further increasing cost. As such the present inventor has identified an unmet need for an inexpensive, low profile, adjustable valve that performs the multiple functions and special operating sequence for the DLC energy saving method.

Current valve technology has not been fully utilized or become accepted practice for most applications. For example, U.S. Pat. No. 5,741,192 discloses a circuit that provides pressure recovery in one direction (assisted by gravity), which is provided by numerous valves, arranged in a complex manner, and requires significant space near the actuator. Installing, adjusting and maintaining this complex array of valves is one of the main reasons for general lack of acceptance of this arrangement. This costly system also is not functional in vacuum operations where the fluid flow (in this case, suction) is in the reverse direction of positive displacement pressure. Although the costs of vacuum generation and use are significant, no current valve technology is available that provides these circuits with energy savings.

In addition, the handing and distribution of vacuum, particularly in vacuum chamber applications, has not extended to the recycling of this expensive medium. These numerous conventional control valves add significant initial cost (plus add operating and adjusting complexity), along with additional maintenance needs. Currently, there is no circuit or hardware that provides the ability to allow recycling of existing vacuum pressure. In conventional operation when vacuum chamber is vented, all vacuum is lost (replaced by atmospheric pressure) and additional vacuum will need to be completely generated for the next cycle.

In certain embodiments of DLCs discussed above (e.g. FIG. 6), a component valve is specified that provides control over the main valve, the actuator and the accumulator functions. To better differentiate the function of the novel valve discussed below, this new embodiment of a component valve will also be referred to as a Sequential Control Valve (SCV) to better reflect the functions that provide recycling of pressure in both positive pressure and vacuum operations. The SCV provides a specific means for providing the function of the component valve specified previously above (e.g. FIG. 6), but is low profile in size for convenience and easy to maintain and control. The "sequential operation" term is used to signify that as the SCV valve shifts back and forth through all positions, the correct operating sequence required for the methods described above for recycling are now provided automatically. The SCV therefore provides a direct, low cost solution by providing novel three and four position valves with specifically designed sequential operation for recycling of both positive and negative pressure (vacuum) using the methods described above.

Figure 8:
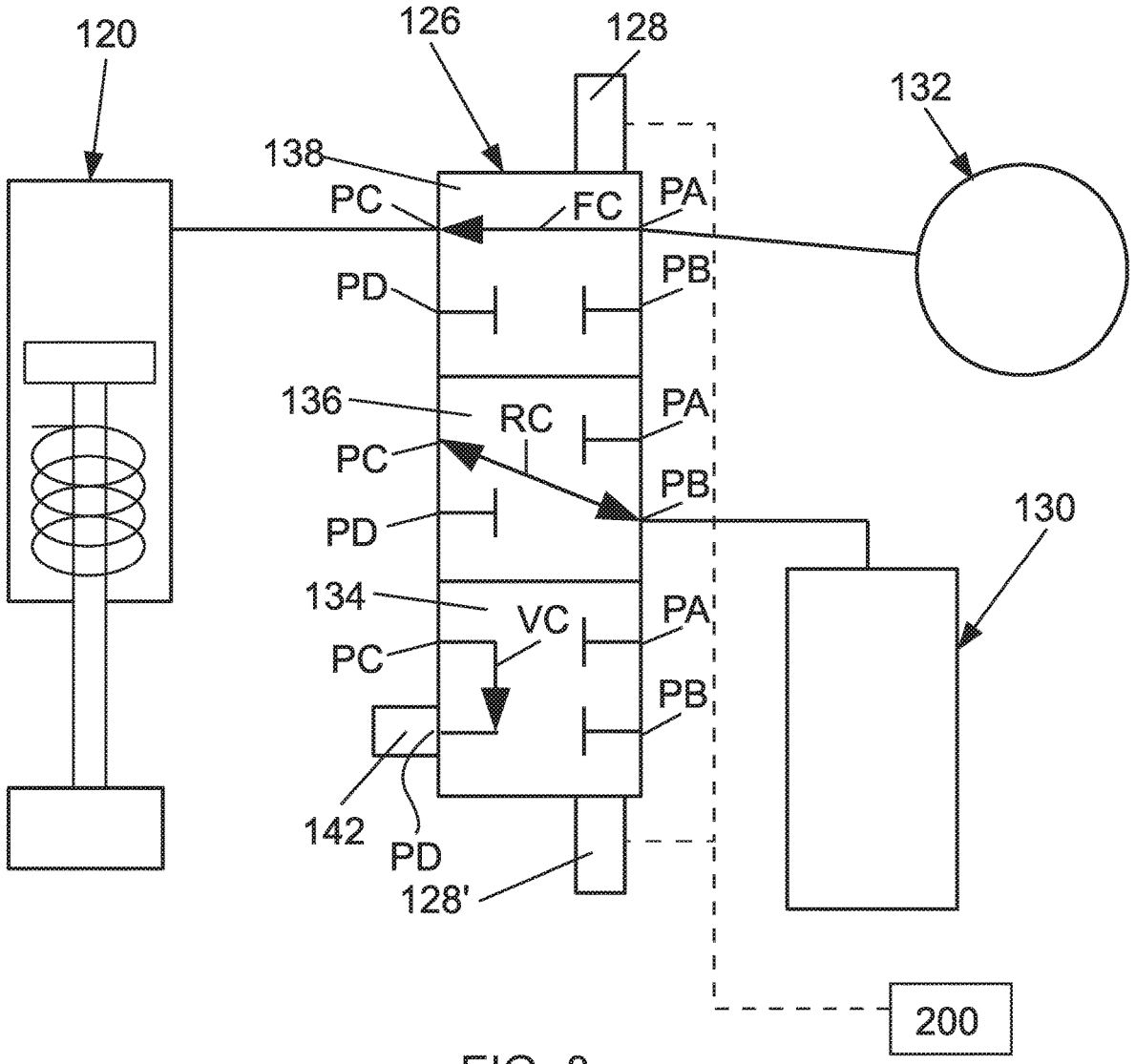
FIG. 8 is a Sequential Control Valve (SCV) in a single acting cylinder.
Figure 10:
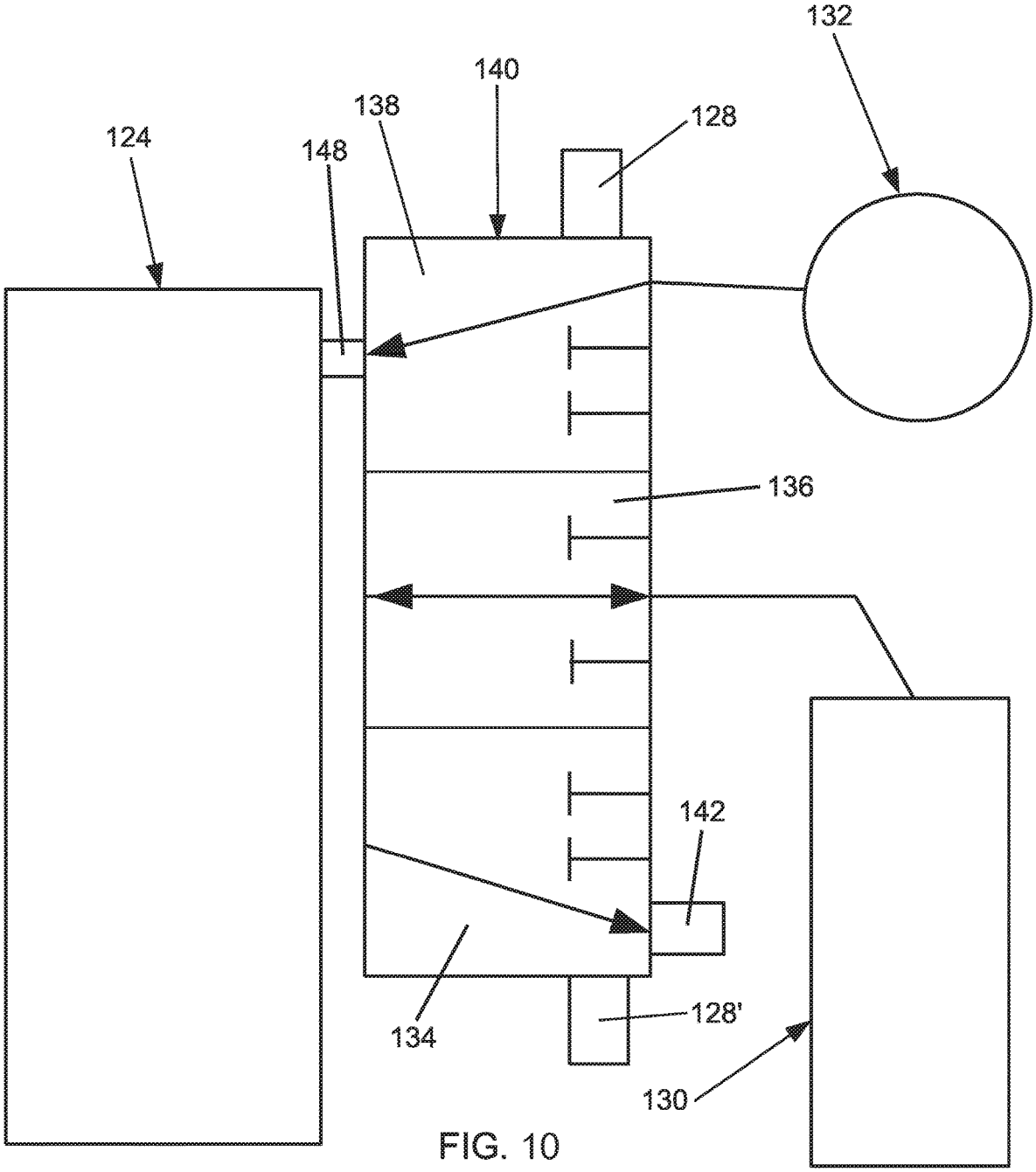
FIG. 10 is a SCV in a direct mount, vacuum chamber application.

The SCV is preferably manufactured as a low profile, "spool" type valve with multiple positions, which is shown oversized in FIG. 8 for clarity. The internal passages connect to various ports that in turn are connected to equipment in conventional manner. It should be noted that the SCV can also be configured as a rotary, sequence or other multi-position valve, and/or may be hand activated, for example. The SCV may also be used for vacuum operations with connections to a vacuum chamber, vacuum source, accumulator (also referred to as a reservoir) and a vent (for vacuum chamber entry), as shown in FIG. 10. The industry terminology for this valve type would be a four (ports), three (position or way) valve or 4/3. The SCV can be used to recycle pressure in various actuators including items such as diaphragm pumps and intensifiers.

The SCV version in FIG. 8 is a spool type and provides ports and passages for connection/disconnection to an actuator, a pressure source, an accumulator (pneumatic or hydraulic) and a vent. In general, the SCV 126 of FIG. 8 provides control of the flow of fluid between the source 132, accumulator 130 (also referred to as a reservoir), a pressure-based device such as a cylinder 120, and a vent (not expressly numbered) coupled at a vent port 142, to be discussed below. The SCV 126 presently shown includes three positions selectable by control of solenoids 128, 128' via a control system 200, also discussed below. The three positions of SCV 126 each include a source port PA configured to be fluidly coupled to the source 132, a reservoir port PB configured to be fluidly coupled to the reservoir or accumulator 130, a device port C configured to be fluidly coupled to the pressure-based device, such as the cylinder 120, and a venting port 142 configured to vent the fluid to atmosphere. In a hydraulic application (not shown), this fluid would be returned by line(s) to an unpressurized fluid tank.

As shown in FIG. 8, the fill position 138 defines a fill conduit FC that fluidly couples the source port PA and the device port PC, the recycle position 136 defines a recycle conduit RC that fluidly couples the reservoir port PB and the device port PC, and the vent position 134 defines a vent conduit VC that fluidly couples the vent port PD and the device port PC. The fill conduit FC, recycle conduit RC, and vent conduit VC each communicate the fluid therethrough and a corresponding one of the positions is selected, and the SCV 126 is configured to prevent selection of more than one position at a time.

Figure 11:
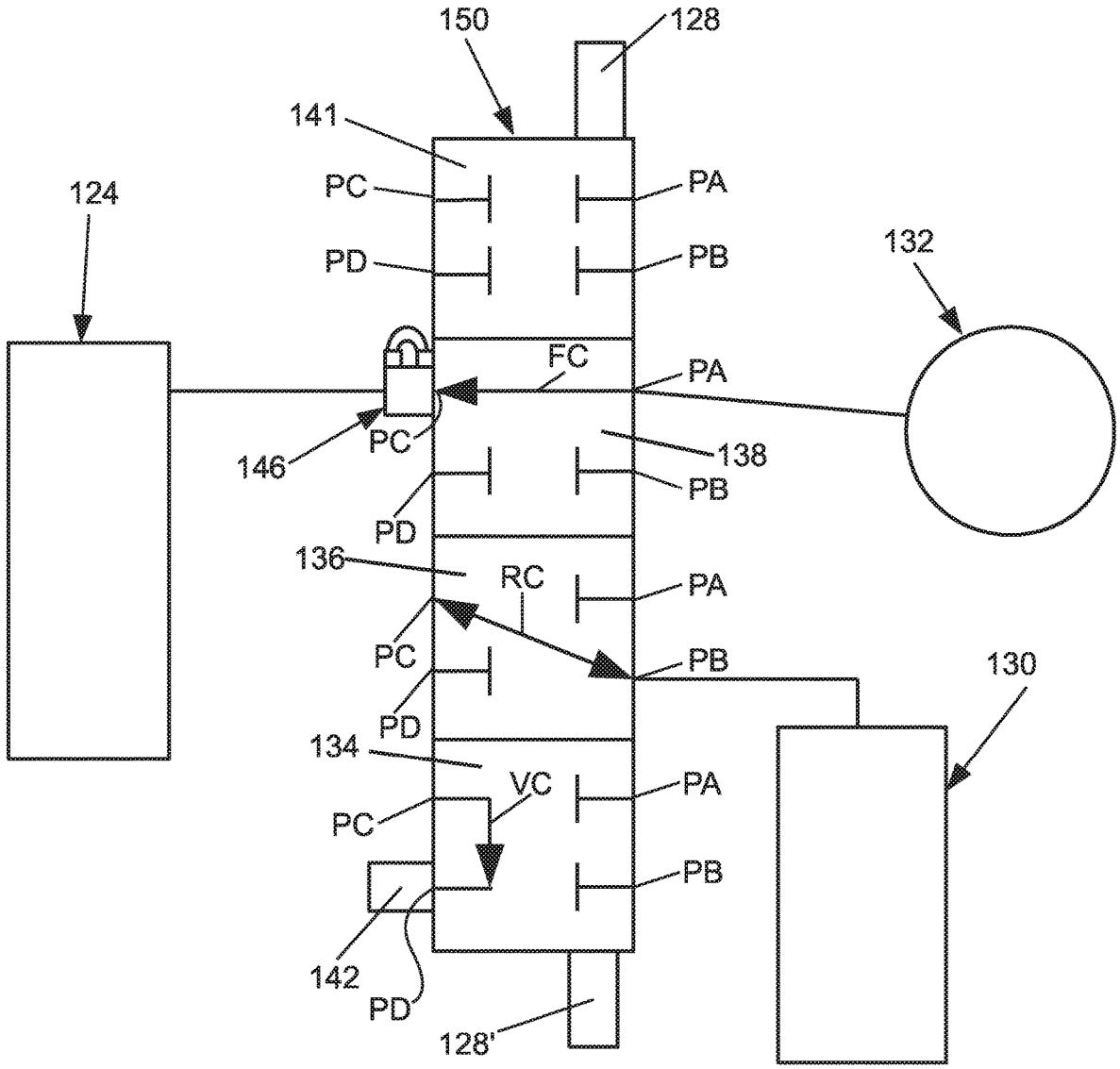
FIG. 11 is a SCV is a four position SCV in a vacuum application.

In certain embodiments, such as that shown in FIG. 11, the SCV 150 further includes an off position 141 in which the device port PC is fluidly uncoupled from the source port PA, the reservoir port PB, and the venting port PD. The three operating positions provide sequential control, in both directions of valve travel, of the fill, recycling and venting of positive pressure or vacuum. For additional energy savings in prolonged operations a four port, four position (4/4) SCV 150 of FIG. 11 further provides an off position 141 to allow shutting down the source 132 providing the initial pressure or vacuum.

Valve shifting may be triggered by control mechanisms such as pilot pressure signals, timing or limit switches including programmable logic controls (PLC, such as the control system 200 of FIG. 12) that can control both spool position and duration of time using electronic solenoids (generically shown as numbers 128, 128' in FIGS. 8-12. Pressure signals from the main valve 120, actuator or accumulator 130 can be utilized to provide "automatic" operation without requiring any additional inputs not already present in the circuit. These control mechanisms are adjustable and can be incorporated in the valve at manufacture for significant cost reductions. The SCV may also be operated by hand controls and/or contain spring biased controls as desired.

If the SCV is spring biased, any number of conventional mechanisms may be utilized to provide the appropriate timing or dwell functions required, such as: adjustable on or off delays, flow controls, timers, etc. These adjustable controls may be integrated at manufacture (not shown) or added to the SVC where desired depending upon application. One example would be the adjustable flow controls from Clippard, such as part number JFC-3APO8 (meter out) or JFC-3BPO8 (meter in).

Additional information is now provided regarding positive pressure operation for the exemplary embodiments of FIGS. 8-12. The SCV directly functions with both single acting and double acting cylinders for added valve versatility. In single acting cylinder applications, such as shown in FIG. 8, a single SCV 126 is connected to the cylinder 120 and accumulator 130 with conventional means. As spring forces returns the single acting cylinder 120 to the initial retracted position for another cycle, pressure is sent (and stored) to the accumulator 130 using the RC passage at recycle position 136. The SCV 126 continues to move to the vent position 134 where low pressure is allowed to vent through the VC passage at vent port 142. At this point the recycled pressure will be stored and available for the next stage of actuator motions.

Figure 9:
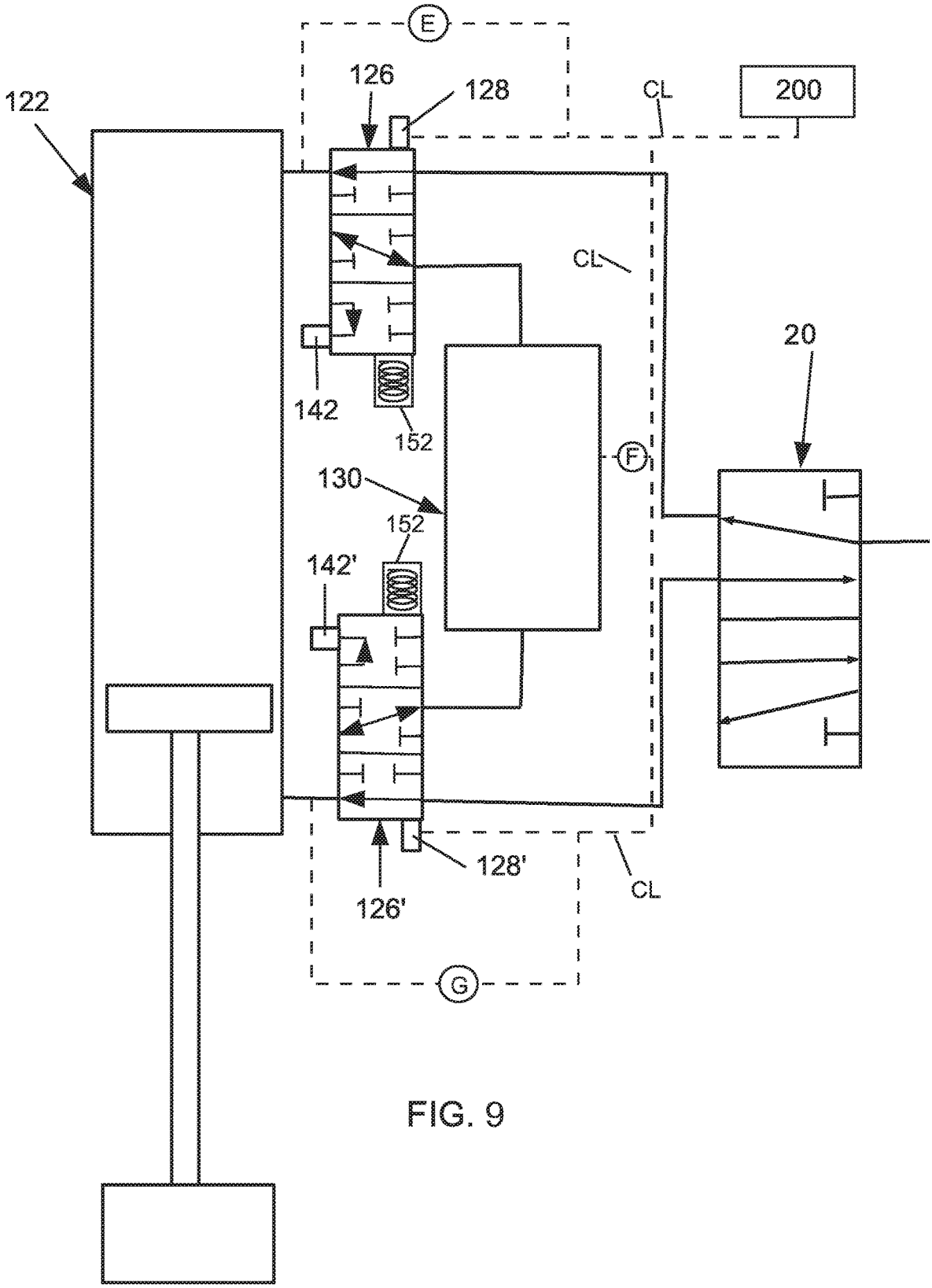
FIG. 9 are two SCV's in a double acting application.

In the double acting cylinder of FIG. 9, the SCV circuit consists of the source 132, valve 126, accumulator 130, cylinder 120 and vent 142—all interconnected as previously stated. The double acting cylinder SCV circuit shown consists of two SCV's, 126, 126', connected to an actuator 122, an accumulator 130, vents 142, 142' and source 132 using conventional means. The SCV's 126, 126', are shown with spring biased mechanisms 152, 152' for simplicity. A SVC circuit can also be constructed of only one SCV (for single acting cylinder or a vacuum chamber) or two SCV (double acting) and, when using a control system 200 on either, will not require a main valve for operation.

This "direct link circuit" connection allows the exhaust from one side to immediately perform additional work on the opposite cylinder end using the DLC method discussed above. There is also sequential venting of the lower, unusable pressure prior to requiring new pressure as covered in the DLC application. Pressure venting through an exhaust muffler or a return to reservoir circuit (hydraulics) is generically shown at the vent position 134 as vent port 142 in FIGS. 8-11.

The operating sequence in which (valve is shifted back and forth through the operating positions of vent 134, recycle 136 and fill 138) for both single and double acting cylinders may be identical. The vent position 134 is connected to atmospheric pressure (open), the recycle position 136 is connected to an accumulator 130 and the fill position 138 is connected to the pressure source 132. For clarity in this application, the operating sequence will start at the vent position 134 (however, in use, the valve may be at any position).

To start operation, the SCV spool is shifted from the vent position 134 (located at one end of the valve body) to the adjacent recycle position 136 where previously accumulated pressure is recycled (see FIGS. 8-11). At each individual operating position all other operating positions are closed and remain "off" until the valve again shifts. An initial operating cycle is required to charge the accumulator 130 and the operation of the SCV 126 from the recycle 136 to the fill 138 position will leave a set amount of pressure within the accumulator 130. The amount of pressure remaining in the accumulator 130 can be determined by a pressure set point or timing of valve shifting (or other control means) and provides a "starting point" for the accumulation of additional pressure upon the next cycle. This allows recycling at higher pressure or vacuum levels, providing significantly more work upon recycling to the actuator or vacuum chamber.

The SCV 126 then is shifted to the next position (fill 138—at the opposite end of the valve body), where full pressure is obtained from the source 130 and flows to the actuator 120. To save pressure for reuse, the SCV 126 is shifted in the reverse direction to the recycle 136 position, where pressure is stored in the accumulator 130, saving this volume for future use. The SCV 126 is then shifted to the vent 134 position, venting the lower remaining pressure in the actuator 120 to atmosphere. A main valve 20 (shifted by any conventional means) may also be used to provide the initial activation of the SCV 126 (see FIG. 9).

Additional information is now provided regarding vacuum operation for the exemplary embodiments of FIGS. 10 and 11. As shown in FIG. 10, operation starts at the vent 134 position where the vacuum chamber 124 can be opened and closed, then moves to the recycle 136 position where vacuum can be accessed or stored in an accumulator 130 and to the fill 138 position where full vacuum pressure is obtained from source 132. The SCV shown is a direct mount 140 version, with only a single center port 148 on the vacuum chamber 124 side of the direct mount 140 version, which allows direct mounting to the vacuum chamber 124 or any actuator.

For operation, the vacuum chamber 124 (or any actuator) is connected to the single center port 148, which provides additional convenience and space savings (particularly as a direct connection). To start operation, the vacuum chamber 124 is closed and the SCV 140 is shifted from the vent 134 position (at one end of the valve body) to the adjacent recycle 136 position where previously accumulated vacuum is utilized. In certain embodiments, one operating cycle is required to initially charge the accumulator 130 and the operation of the SCV 140 from the recycle 136 to the fill 138 position will leave a set amount of vacuum within the accumulator 130.

In general, the amount of vacuum remaining will be determined by the pressure set point or timing of the valve shifting (or other control means) and provides a "starting point" for the accumulation of vacuum upon the next cycle. This allows the conservation and use of the vacuum volume at higher vacuum levels, providing significantly more work upon recycling. The SCV 140 then is shifted to the next position (fill 138—at the opposite end of the valve), where full vacuum is obtained from the vacuum source 132.

To save vacuum for reuse, the SCV 140 is shifted in the reverse direction to the recycle 136 position, where vacuum is created in the accumulator 130, which saves this volume of vacuum for future use. The SCV 140 is then shifted to the vent 134 position, venting the lower remaining vacuum to allow atmospheric pressure into the circuit, which allows the vacuum chamber 124 to be opened. Once the vacuum chamber 124 is again closed, operation can be resumed to start the sequence again. It should be noted that each operating position the other operating positions are closed and remain "off" until the valve again shifts.

Additional information is now provided regarding an exemplary four position sequential control valve according to the present disclosure. To provide additional energy savings, a four position (4/4) Sequential Control Valve 150 can be utilized, such as the SCV of FIG. 11. The fourth valve position provides an off 141 (in other words, disconnected) position to all ports once full vacuum is obtained.

This off 140 position allows the source 130 (vacuum pump or compressor) to be turned off, allowing the pump to shut down for energy savings during prolonged vacuum operations. In certain embodiments, this off 140 position occupies the "last" operating position at valve end (as shown in FIG. 11) so that the natural valve movement again travels through all positions in the correct operating sequence. For complete operation, and to recycle vacuum, the valve travels in the reverse direction, through all positions, back to the original vent 134 position. Incorporated sensors (not shown) can monitor the vacuum state, for example at the actuator, vacuum chamber and/or line, and can re-open the fill 138 stage (if needed) to replenish vacuum from source.

Alternate modes for operating certain embodiments of SCVs according to the present disclosure. A safety shutoff/vent mechanisms can also be incorporated into a three 126 or four position 140 with the OSHA required lockout/shutoff features 146 added, such as shown in the SVC of FIG. 11. One example of such a valve would be SMC's lockout/tagout valve number VHS 30-NO2B-Z. The duration of time at each operating position can be controlled by conventional means such as timer, control system 200 logic (or an electronic input for a solenoid valve) a conventional feedback loop, system pressure sensors, for example (see FIG. 9). Valve operating positions can be also be directly controlled by conventional controls such as timers, flow controls, electronics, or level of pressure or vacuum through a feedback loop mechanism.

In positive pressure applications, energy savings of 50% are possible over conventional circuit operation by using recycled pressure for both extend and retract operations.

Using a SCV and accumulator to recycle vacuum offers substantial energy savings by re-establishing vacuum by first using a recycling process. Also, the time required to fill and empty the chamber can be reduced, thereby speeding up operations.

The recycled vacuum has also already been significantly de-humidified by the initial vacuum operation, and at significant cost. Recycling using the SCV 140 and accumulator 130 provide additional time and money savings that would otherwise require complete de-humidification of all the volume in a conventional operation (for example using the configuration shown in FIGS. 10 and 11. For retrofitting existing systems, a main control valve can initiate the on/off function of the circuit, with the SVC running "automatically" using the main valve signal output or absence of pressure. A Sequential Control Valve can also be used for controlling all operations, providing direct and total replacement of the original main control valve.

Figure 12:
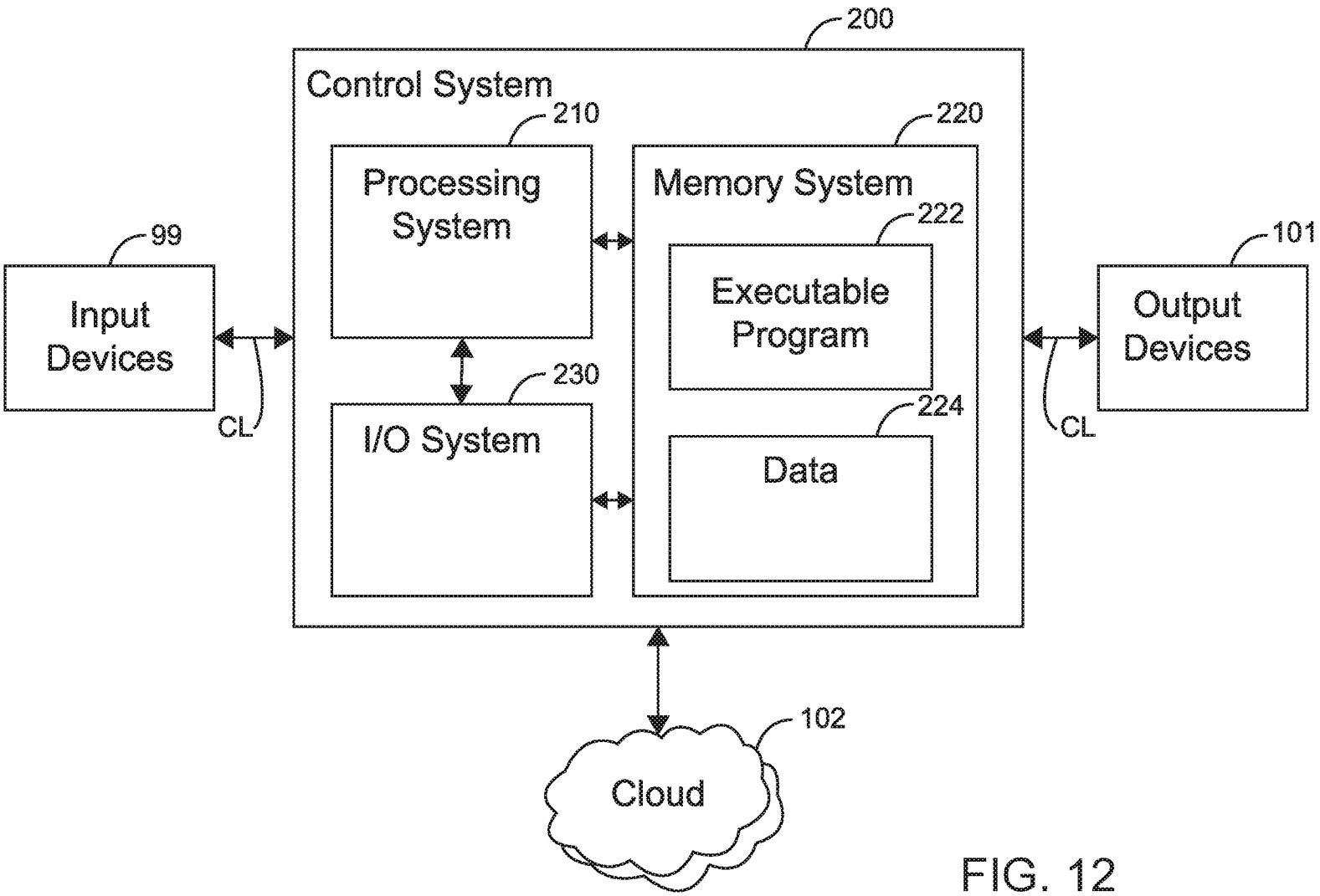
FIG. 12 is an exemplary control system for operating an SCV circuit according to the present disclosure.

FIG. 12 depicts an exemplary control system 200 for operating an SCV circuit according to the present disclosure.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 200 communicates with each of the one or more components of the SCV circuit via a communication link CL, which can be any wired or wireless link. The control system 200 is capable of receiving information and/or controlling one or more operational characteristics of the SCV circuit and its various sub-systems (for example, the pressure states at points E, F, G shown in FIG. 9) by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the SCV circuit. Moreover, the communication link CL lines are meant only to demonstrate that the various control elements are capable of communicating with one another, and do not represent actual wiring connections between the various elements, nor do they represent the only paths of communication between the elements. Additionally, the SCV circuit may incorporate various types of communication devices and systems, and thus the illustrated communication links CL may in fact represent various different types of wireless and/or wired data communication systems.

The control system 200 may be a computing system that includes a processing system 210, memory system 220, and input/output (I/O) system 230 for communicating with other devices, such as input devices 99 and output devices 101, either of which may also or alternatively be stored in a cloud 102. The processing system 210 loads and executes an executable program 222 from the memory system 220, accesses data 224 stored within the memory system 220, and directs the SCV circuit to operate as described in further detail below.

The processing system 210 may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices.

The memory system 220 may comprise any storage media readable by the processing system 210 and capable of storing the executable program 222 and/or data 224. The memory system 220 may be implemented as a single storage device, or be distributed across multiple storage devices or sub-systems that cooperate to store computer readable instructions, data structures, program modules, or other data. The memory system 220 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

What is claimed is:

1. A valve for controlling a flow of a fluid between a source, a reservoir, and a pressure-based device having a first side, the valve comprising:

a plurality of positions each having a source port configured to be fluidly coupled to the source, an reservoir port configured to be fluidly coupled to the reservoir, a device port configured to be fluidly coupled to the first side of the pressure-based device, and a venting port configured to vent the fluid, wherein the plurality of positions are separately selectable and include:

a fill position having a fill conduit that fluidly couples the source port and the device port;

a recycle position having a recycle conduit that fluidly couples the reservoir port and the device port, wherein the fluid flows from the reservoir to the first side of the pressure-based device via the recycle conduit, and wherein the fluid flows from the first side of the pressure-based device to the reservoir only via the recycle conduit;

a vent position having a vent conduit that fluidly couples the vent port and the device port;

wherein the fill conduit, the recycle conduit, and the vent conduit each communicate the fluid only when a corresponding one of the plurality of positions is selected, and wherein the plurality of positions are configured to prevent selection of more than one at a time.

2. The valve according to claim 1, wherein the pressure-based device is a cylinder, and wherein the valve is configured to move a piston assembly within the cylinder by controlling the flow of the fluid.

3. The valve according to claim 1, wherein the valve is a spool-type valve.

4. The valve according to claim 1, wherein the valve has at least two faces opposing each other, and wherein the device port is positioned on one of the at least two faces that is different than that of the source port, the reservoir port, and the venting port such that the valve is mountable directly on the pressure-based device.

5. The valve according to claim 1, wherein the plurality of positions further includes an off position in which the device port is fluidly uncoupled from the source port, the reservoir port, and the venting port.

6. The valve according to claim 1, wherein selection among the plurality of positions is electronically performed by a control system.

7. A system for conserving energy in operating a pressure-based device by controlling a flow of a fluid between a source, a reservoir, a vent, and the pressure-based device having a first side, the system comprising:

a valve for controlling the flow of the fluid between the source, the reservoir, and the pressure-based device, the valve comprising:

a plurality of positions each having a source port configured to be fluidly coupled to the source, an reservoir port configured to be fluidly coupled to the reservoir, a device port configured to be fluidly coupled to the first side of the pressure-based device, and a venting port configured to vent the fluid, wherein the plurality of positions are separately selectable and include:

a fill position having a fill conduit that fluidly couples the source port and the device port;

a recycle position having a recycle conduit that fluidly couples the reservoir port and the device port, wherein the fluid flows from the reservoir to the first side of the pressure-based device via the recycle conduit, and wherein the fluid flows from the first side of the pressure-based device to the reservoir only via the recycle conduit;

a vent position having a vent conduit that fluidly couples the vent port and the device port; and a selection device for selecting among the plurality of positions;

wherein the fill conduit, the recycle conduit, and the vent conduit each communicate the fluid only when a corresponding one of the plurality of positions is selected, and wherein the plurality of positions are configured to prevent selection of more than one at a time.

8. The valve according to claim 7, further comprising a lockout device, wherein the lockout device that when locked prevents the fluid from flowing between the valve and the pressure-based device.

9. The system according to claim 7, wherein the pressure-based device is a cylinder and a piston assembly is moved within the cylinder using the fluid, wherein the cylinder has a second side that is opposite the first side, wherein the piston assembly has a piston that moveably separates the first side and the second side of the cylinder, wherein the valve is a first valve fluidly coupled to the first side of the cylinder to control the flow of the fluid thereto and therefrom, further comprising a second valve fluidly coupled to the second side of the cylinder to control the flow of the fluid between the source, the reservoir, and the second side of the cylinder, the valve comprising:

a plurality of positions each having a source port configured to be fluidly coupled to the source, an reservoir port configured to be fluidly coupled to the reservoir, a device port configured to be fluidly coupled to the second side of the cylinder, and a venting port configured to vent the fluid, wherein the plurality of positions are separately selectable and include:

a fill position having a fill conduit that fluidly couples the source port and the device port;

a recycle position having a recycle conduit that fluidly couples the reservoir port and the device port, wherein the fluid flows from the reservoir to the second side of the pressure-based device via the recycle conduit, and wherein the fluid flows from the second side of the pressure-based device to the reservoir only via the recycle conduit; and a vent position having a vent conduit that fluidly couples the vent port and the device port; and wherein the fill conduit, the recycle conduit, and the vent conduit each communicate the fluid only when a corresponding one of the plurality of positions is selected, and wherein the plurality of positions are configured to prevent selection of more than one at a time.

10. The system according to claim 9, wherein the reservoir port of the recycle position for the first valve and the reservoir port of the recycle position for the second valve are both configured to fluidly communicate with the reservoir.

11. The system according to claim 9, further comprising a common controller that controls the operation of both the first valve and the second valve.

12. The system according to claim 7, wherein the valve is a spool-type valve.

13. The system according to claim 7, wherein the source is a vacuum source providing negative pressure.

14. The system according to claim 7, wherein the plurality of positions further includes an off position in which the device port is fluidly uncoupled from the source port, the reservoir port, and the venting port.

15. The system according to claim 7, wherein the selection device is a control system that electronically selects among the plurality of positions.

16. A method for conserving energy while using a pressure-based device operated by controlling a flow of a fluid between a source, a reservoir, a vent, and the pressure-based device having a first side, the method comprising:

fluidly coupling a valve between the source, the reservoir, the vent, and the pressure-based device;

configuring the valve to have a plurality of positions each having a source port configured to be fluidly coupled to the source, an reservoir port configured to be fluidly coupled to the reservoir, a device port configured to be fluidly coupled to the first side of the pressure-based device, and a venting port configured to vent the fluid to atmosphere;

configuring the valve such that the plurality of positions are separately selectable; configuring the valve to perform each of:

positioning the valve in a fill position among the plurality of positions in which the source port and the device port are fluidly coupled;

positioning the valve in a recycle position among the plurality of positions in which the reservoir port and the device port are fluidly coupled, wherein the fluid flows from the reservoir to the first side of the pressure-based device via the recycle conduit, and wherein the fluid flows from the first side of the pressure-based device to the reservoir only via the recycle conduit;

positioning the valve in a vent position among the plurality of positions in which the vent port and the device port are fluidly coupled; and configuring the valve to prevent selecting more than one of the plurality of positions at a time;

wherein energy is conserved when the fluid flows through the valve in the recycle position.

17. The method according to claim 16, wherein the pressure-based device is a cylinder and a piston assembly is moved within the cylinder using the fluid, wherein the cylinder has a second side that is opposite the first side, wherein the piston assembly has a piston that moveably separates the first side and the second side of the cylinder, wherein the valve is a first valve fluidly coupled to the first side of the cylinder to control the flow of the fluid thereto and therefrom, further comprising fluidly coupling a second valve to the second side of the cylinder to control the flow of the fluid between the source, the reservoir, and the second side of the cylinder, the valve comprising:

a plurality of positions each having a source port configured to be fluidly coupled to the source, an reservoir port configured to be fluidly coupled to the reservoir, a device port configured to be fluidly coupled to the second side of the cylinder, and a venting port configured to vent the fluid, wherein the plurality of positions are separately selectable and include:

a fill position having a fill conduit that fluidly couples the source port and the device port;

a recycle position having a recycle conduit that fluidly couples the reservoir port and the device port, wherein the fluid flows from the reservoir to the second side of the pressure-based device via the recycle conduit, and wherein the fluid flows from the second side of the pressure-based device to the reservoir only via the recycle conduit; and a vent position having a vent conduit that fluidly couples the vent port and the device port; and wherein the fill conduit, the recycle conduit, and the vent conduit each communicate the fluid only when a corresponding one of the plurality of positions is selected, and wherein the plurality of positions are configured to prevent selection of more than one at a time.

18. The method according to claim 17, wherein the reservoir port of the recycle position for the first valve and the reservoir port of the recycle position for the second valve are both configured to fluidly communicate with the reservoir.

19. The method according to claim 16, wherein the valve is a spool-type valve and the selection device is a control system that electronically selects among the plurality of positions.

20. The method according to claim 16, wherein the plurality of positions further includes an off position in which the device port is fluidly uncoupled from the source port, the reservoir port, and the venting port.

* * * * *